US009832557B2

(12) United States Patent
Park et al.

(10) Patent No.: US 9,832,557 B2
(45) Date of Patent: Nov. 28, 2017

(54) SLIM MICROSPEAKER

(71) Applicant: EM-TECH. Co., Ltd., Busan (KR)

(72) Inventors: Kil Dong Park, Busan (KR); Seul Ki Nam, Gyeongsangnam-do (KR); Ji Hoon Kim, Gyeongsangnam-do (KR); Min Chang Kim, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 14/968,295

(22) Filed: Dec. 14, 2015

(65) Prior Publication Data

US 2016/0173990 A1 Jun. 16, 2016

(30) Foreign Application Priority Data

Dec. 15, 2014 (KR) ..... 10 2014 0180278
Mar. 11, 2015 (KR) ..... 10 2015 0033854
Mar. 11, 2015 (KR) ..... 10 2015 0033855

(51) Int. Cl.

| | |
|---|---|
| ***H04R 25/00*** | (2006.01) |
| ***H04R 1/06*** | (2006.01) |
| ***H04R 9/04*** | (2006.01) |
| *H04R 7/04* | (2006.01) |
| *H04R 7/18* | (2006.01) |

(52) U.S. Cl.
CPC ..... *H04R 1/06* (2013.01); *H04R 9/043* (2013.01); *H04R 7/04* (2013.01); *H04R 7/18* (2013.01)

(58) Field of Classification Search
CPC ..... H04R 1/06; H04R 9/043; H04R 7/04
USPC ..... 381/433, 354, 404
See application file for complete search history.

(56) References Cited

U.S. PATENT DOCUMENTS

2011/0075880 A1 3/2011 Kamimura et al.
2013/0156237 A1 6/2013 Kim
2014/0355816 A1* 12/2014 Jeong ..... H04R 1/00 381/433

FOREIGN PATENT DOCUMENTS

EP 0720415 A2 7/1996
EP 1768447 A2 3/2007
EP 2709381 A2 3/2014
EP 2797342 A1 10/2014
EP 2811759 A1 12/2014
(Continued)

*Primary Examiner* — Davetta W Goins
*Assistant Examiner* — Phylesha Dabney
(74) *Attorney, Agent, or Firm* — Murphy, Bilak & Homiller, PLLC

(57) ABSTRACT

A microspeaker includes a frame, magnetic circuit, voice coil configured to generate vibration by mutual electromagnetic force with the magnetic circuit, vibration plate configured to vibrate together according to the vibration of the voice coil to generate a sound, and suspension configured to guide a vibration direction of the vibration plate and voice coil. The suspension has a central portion attached to the voice coil, an annular outer circumferential portion formed to be spaced apart from the central portion by a predetermined interval, and a connection portion connecting the central and outer circumferential portions and configured to perform a damping function. The central portion has an outer end having the same height as the connection and outer circumferential portions, an inner end positioned to be higher than the outer end, and a step portion connecting the outer end and inner end. The voice coil is attached to the inner end.

22 Claims, 15 Drawing Sheets

(56) References Cited

FOREIGN PATENT DOCUMENTS

| | | | |
|---|---|---|---|
| JP | 2006191252 | A | 7/2006 |
| KR | 20130140493 | A | 12/2013 |
| KR | 101363512 | B1 | 2/2014 |
| KR | 101468629 | B1 | 12/2014 |
| KR | 101481649 | B1 | 1/2015 |

* cited by examiner

[Fig. 1 (PRIOR ART)]
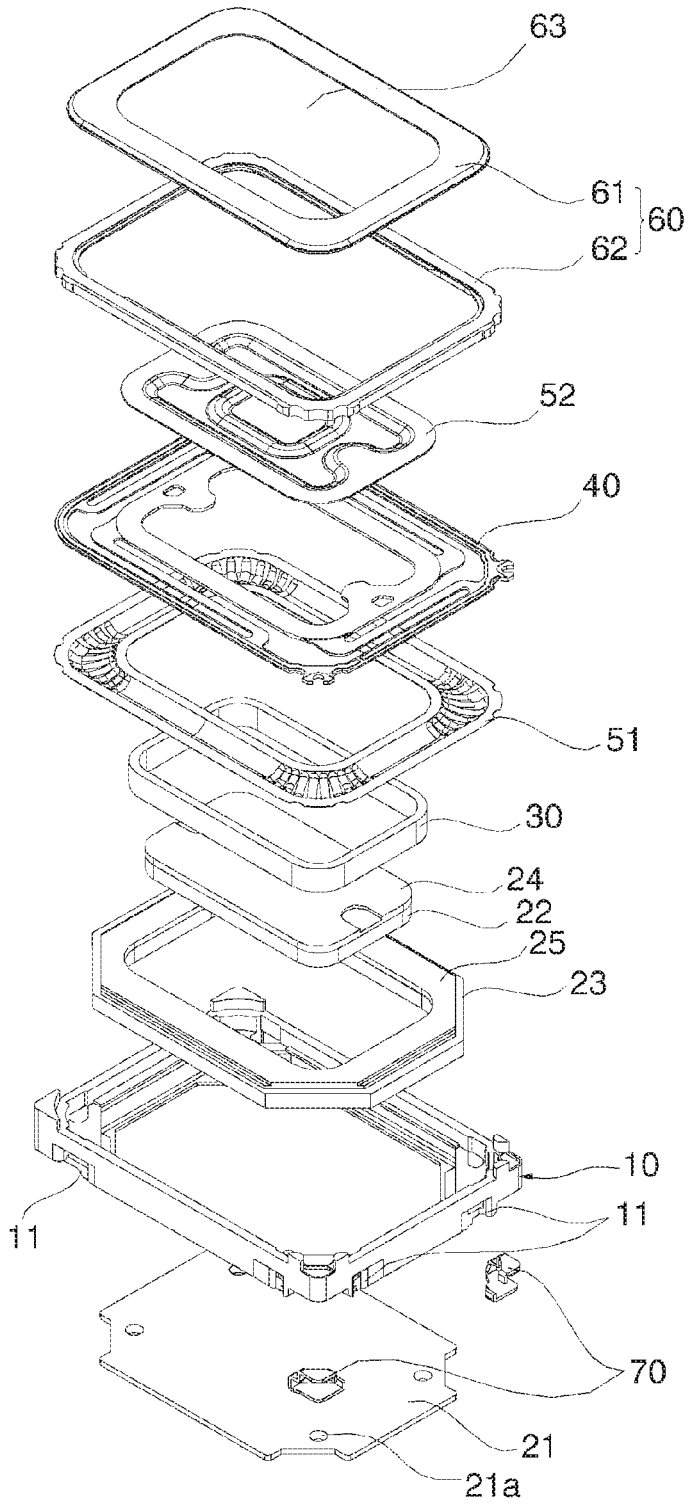

[Fig. 2 (PRIOR ART)]
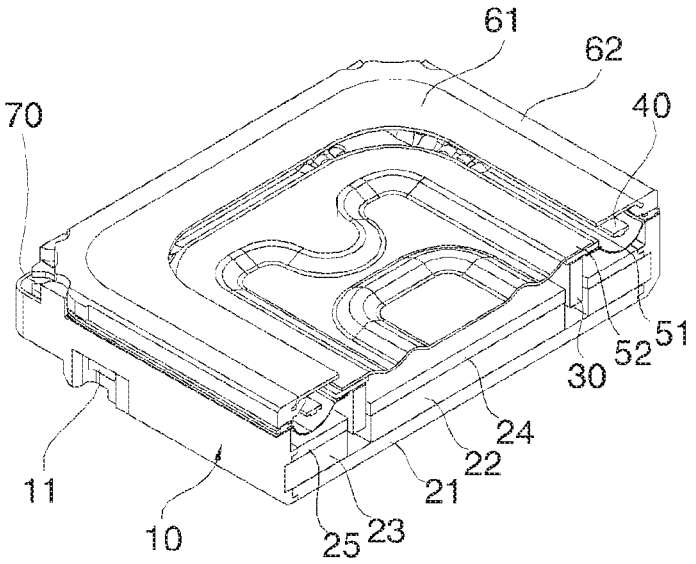

[Fig. 3]
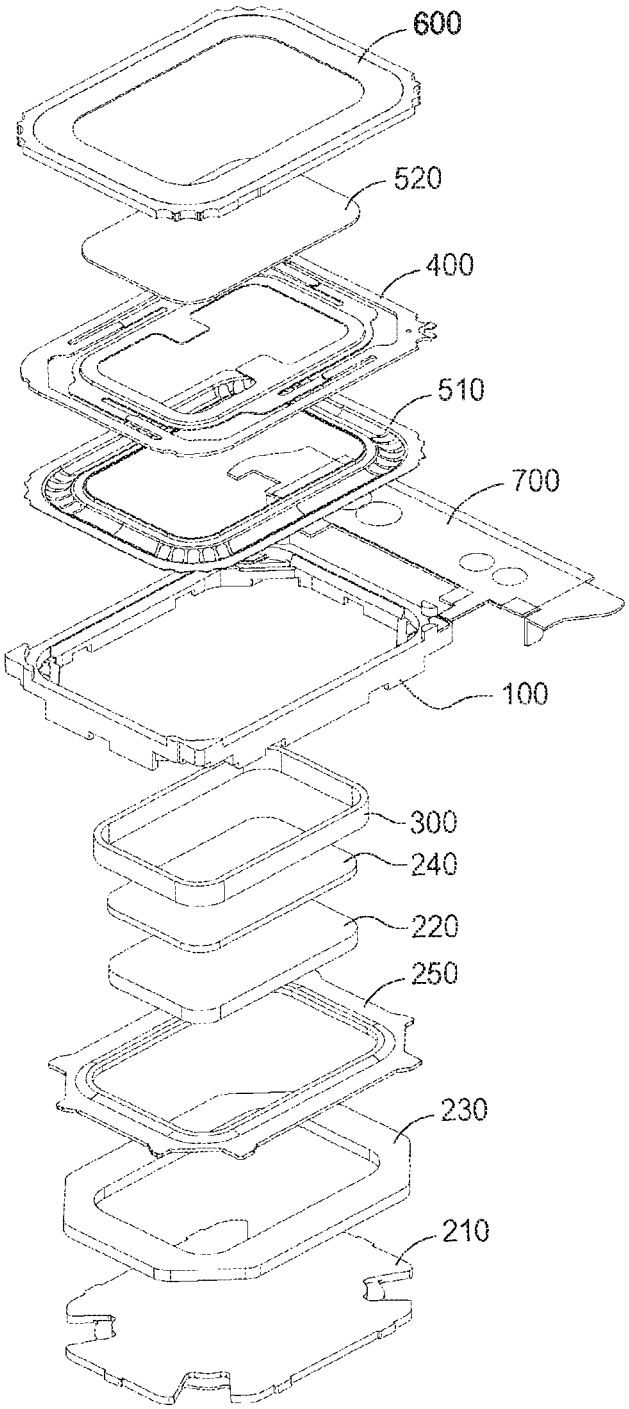

[Fig. 4]
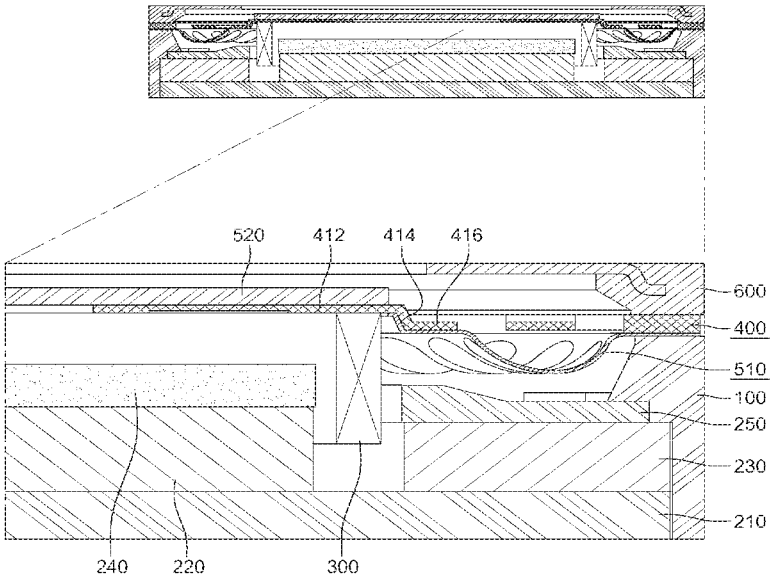
[Fig. 5]
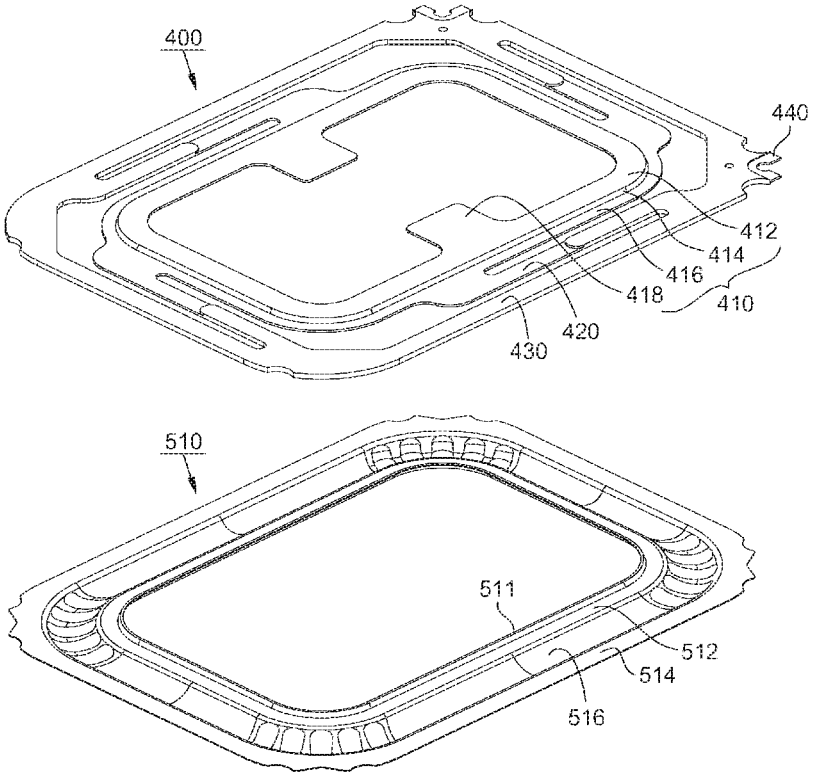

[Fig. 6]
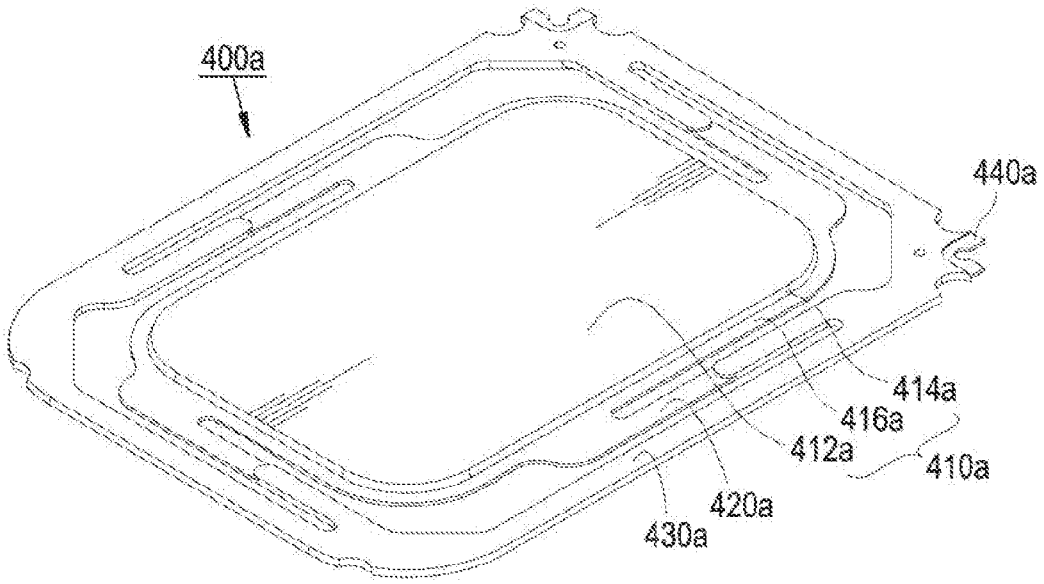
[Fig. 7]
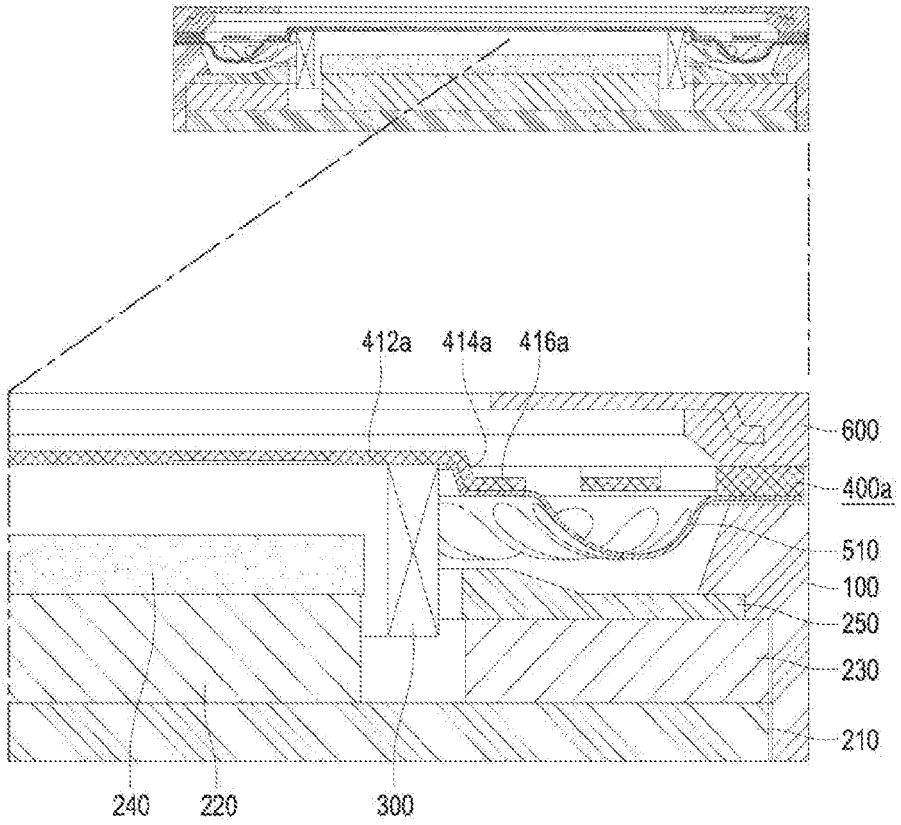

[Fig. 8]
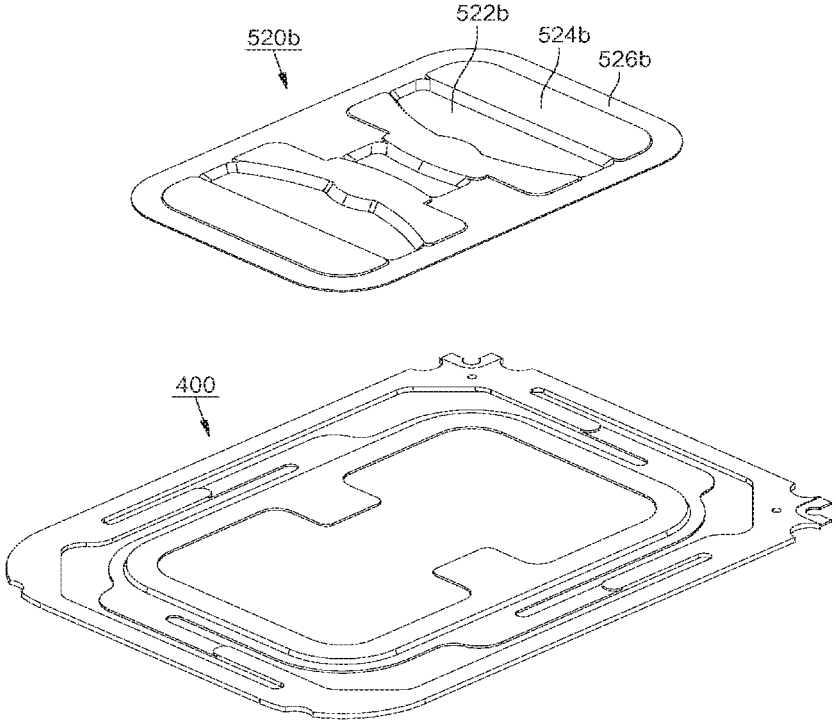
[Fig. 9]
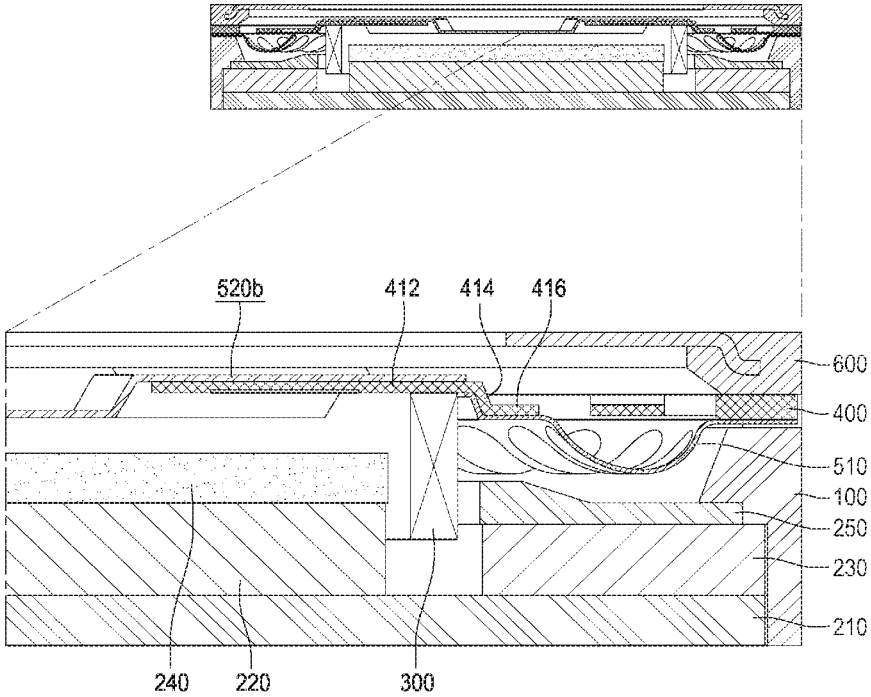

[Fig. 10]
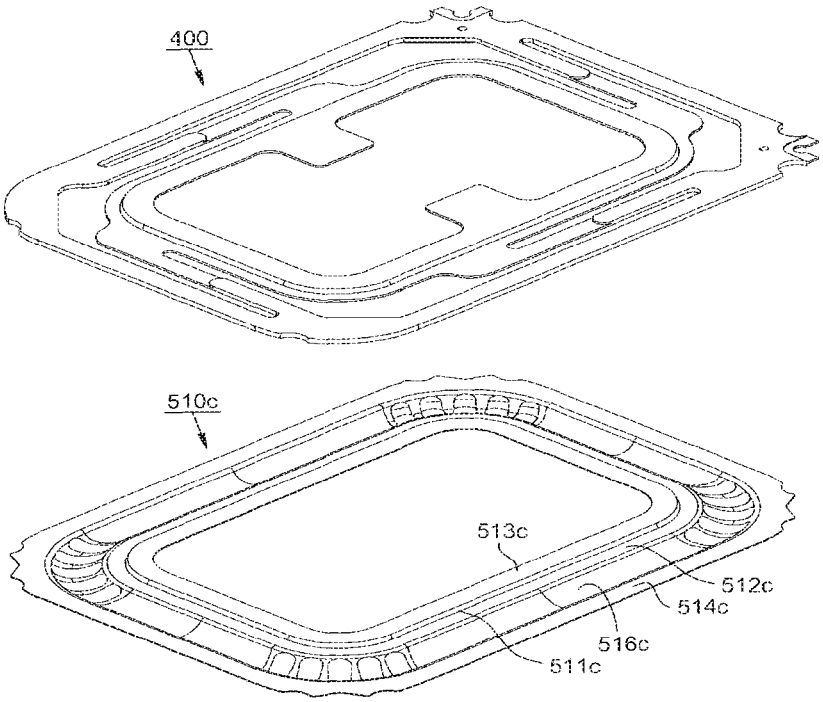
[Fig. 11]
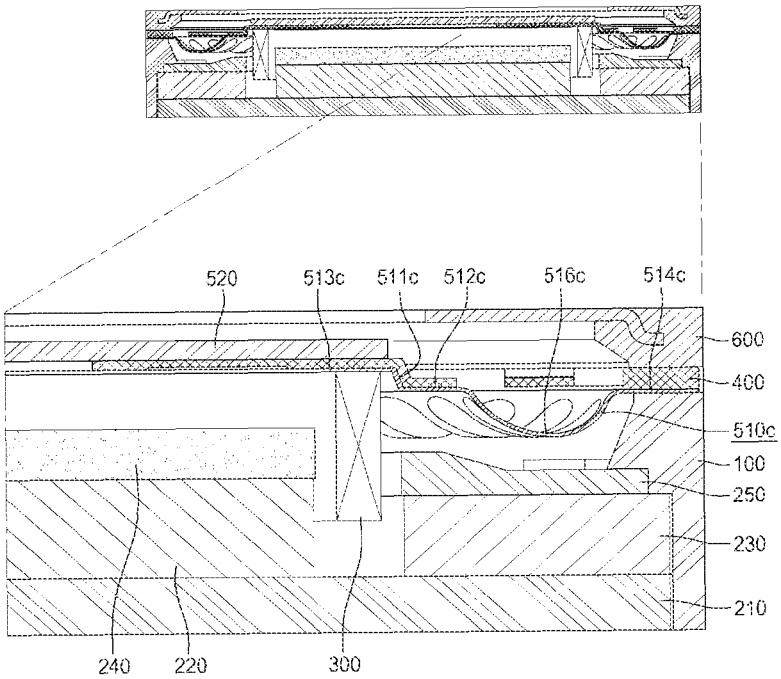

[Fig. 12]
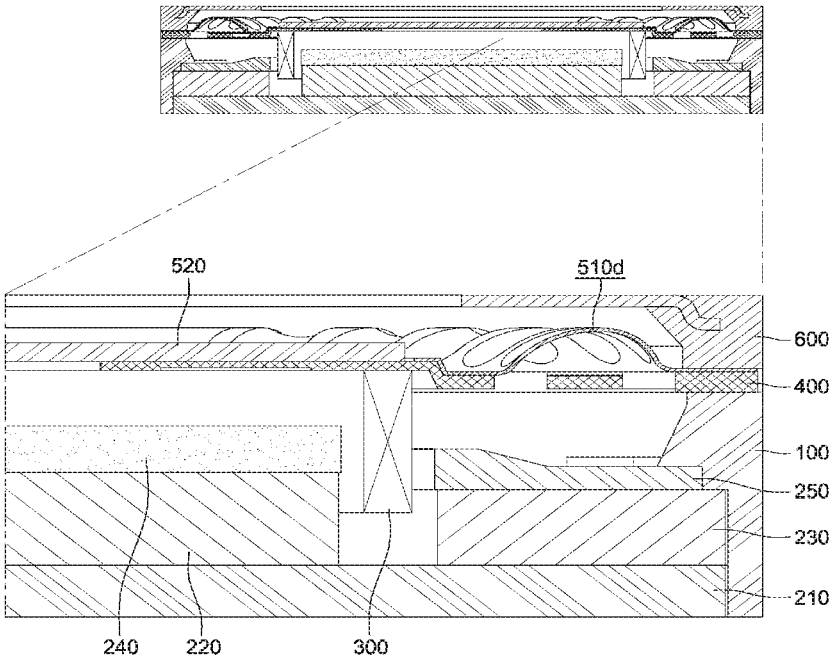
[Fig. 13]
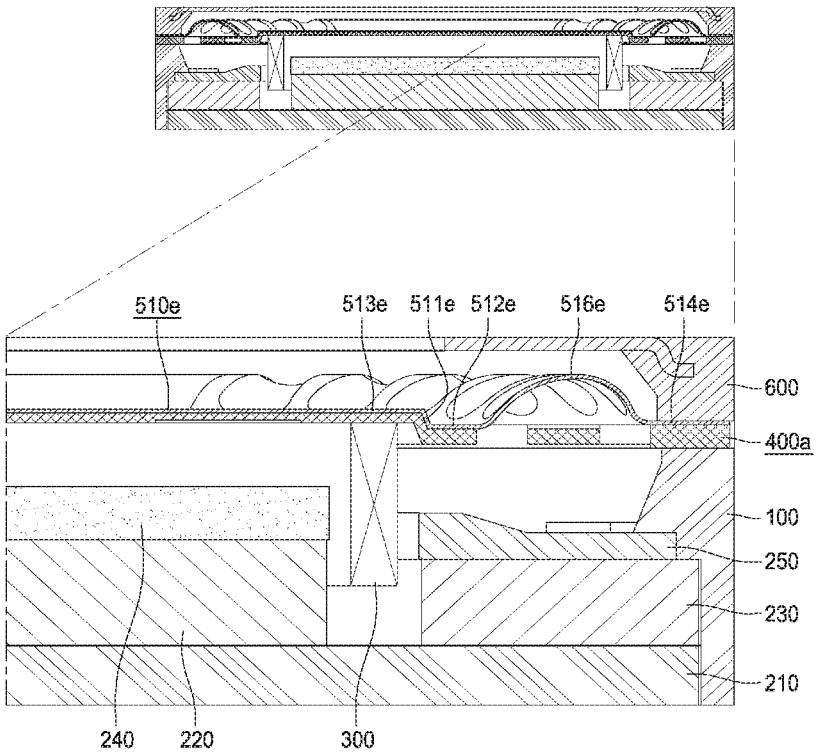

[Fig. 14]
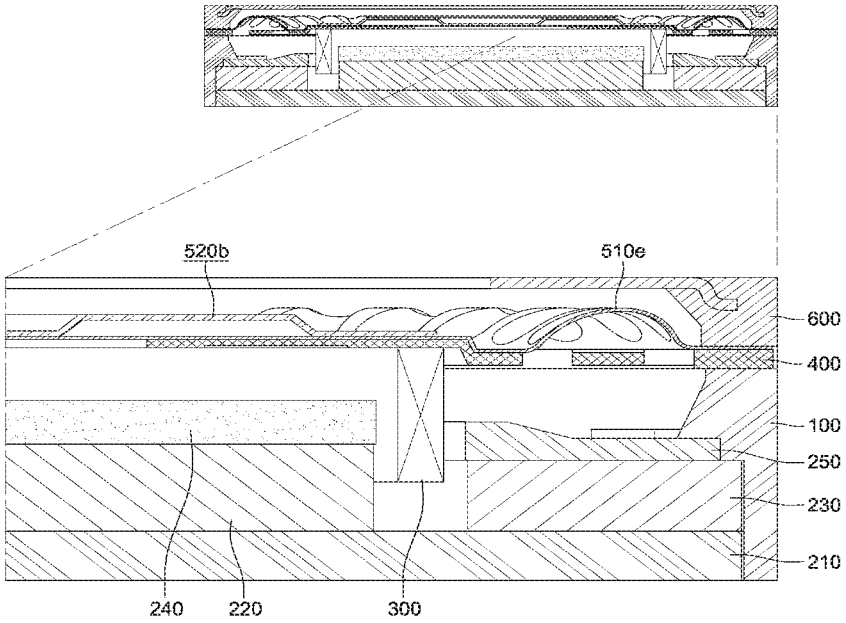
[Fig. 15]
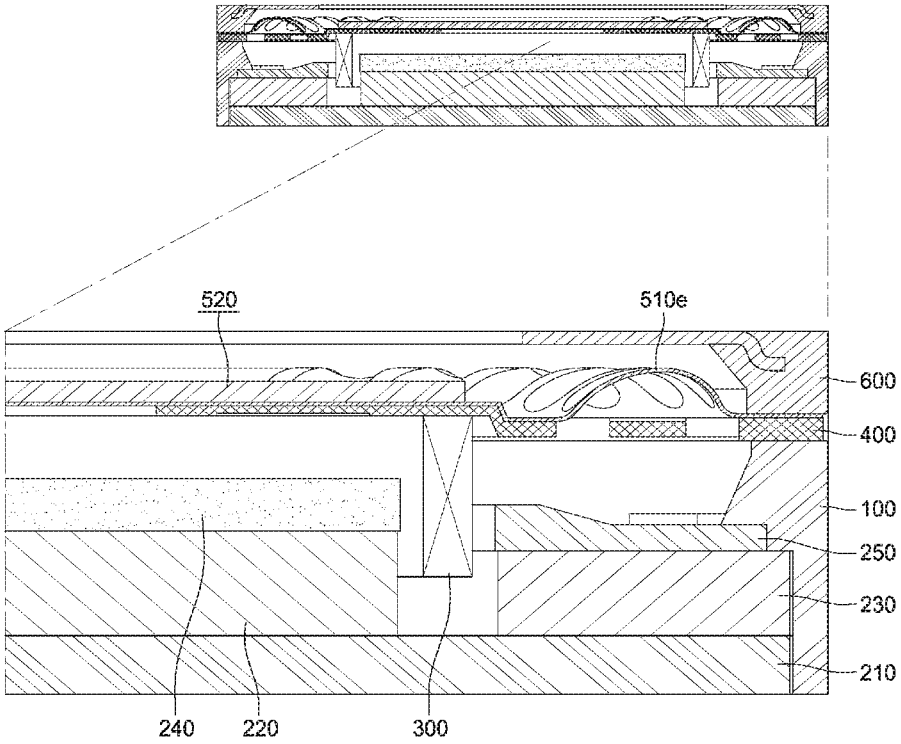

[Fig. 16]
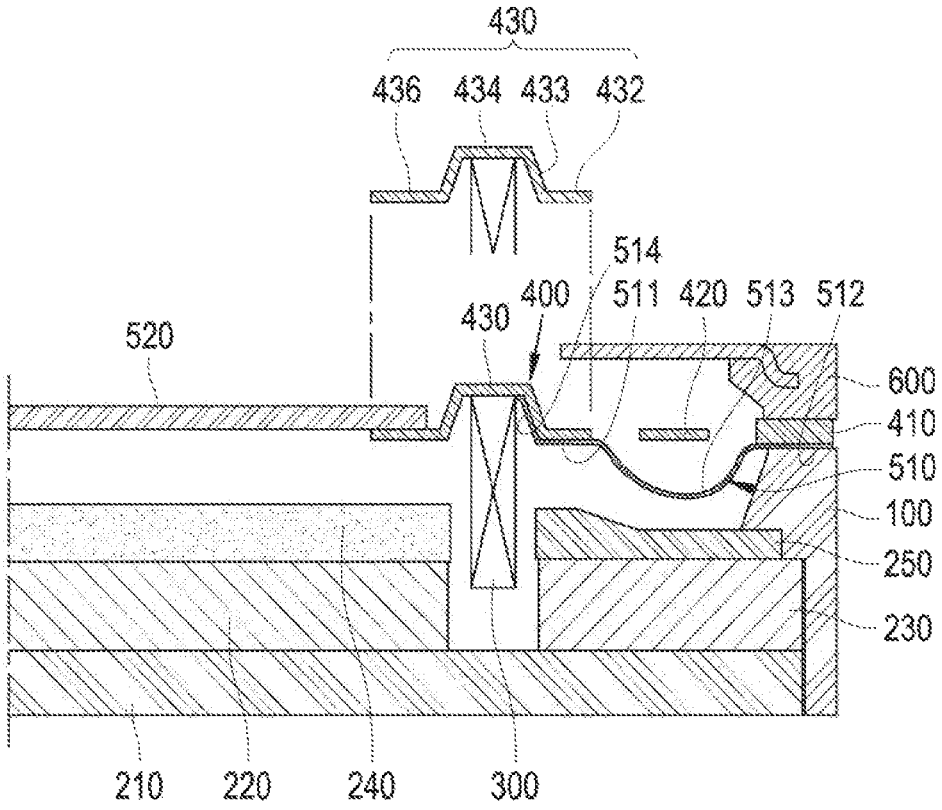
[Fig. 17]
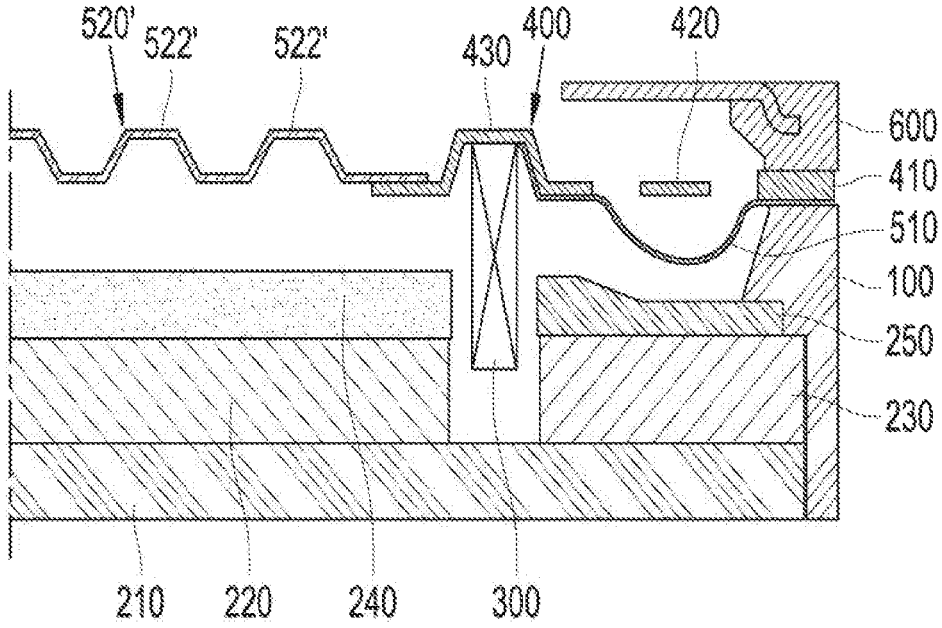

[Fig. 18]
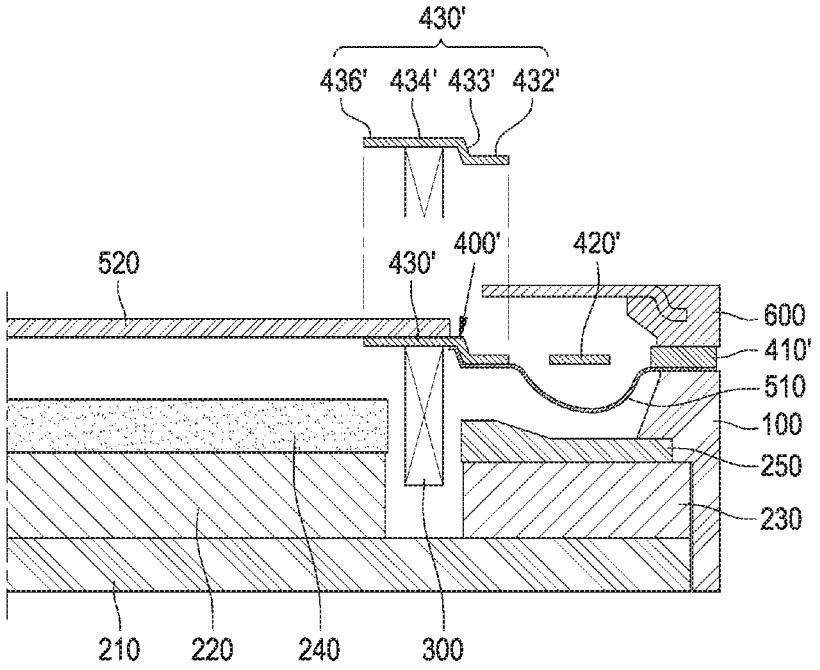
[Fig. 19]
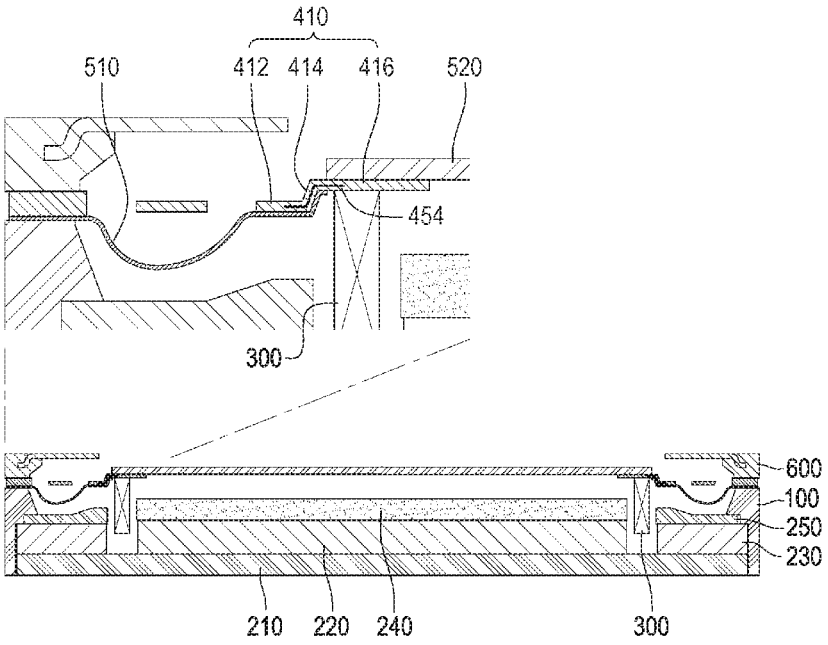

[Fig. 20]
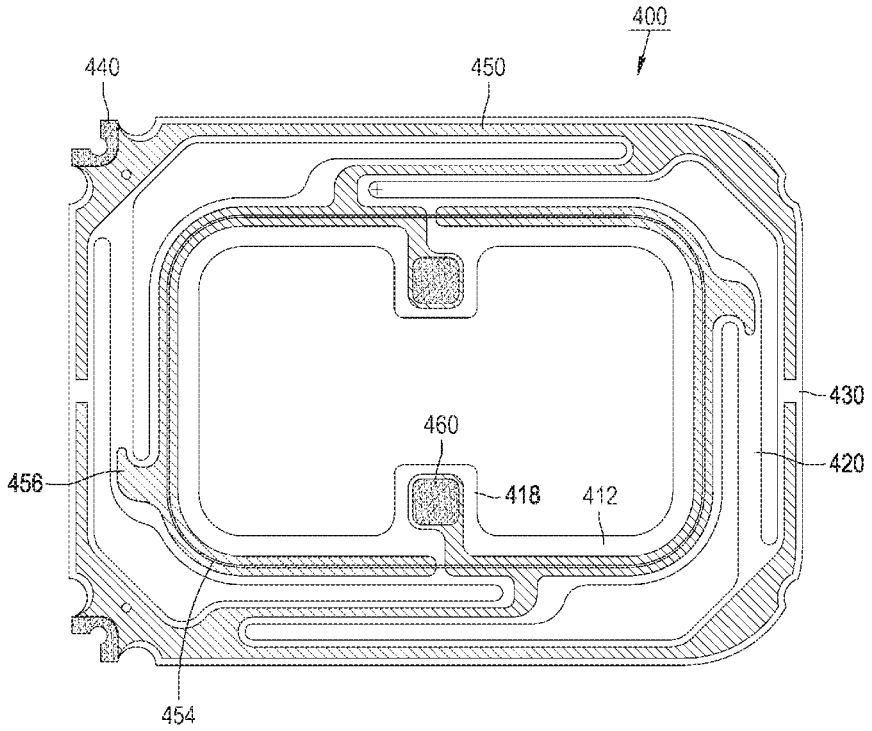
[Fig. 21]
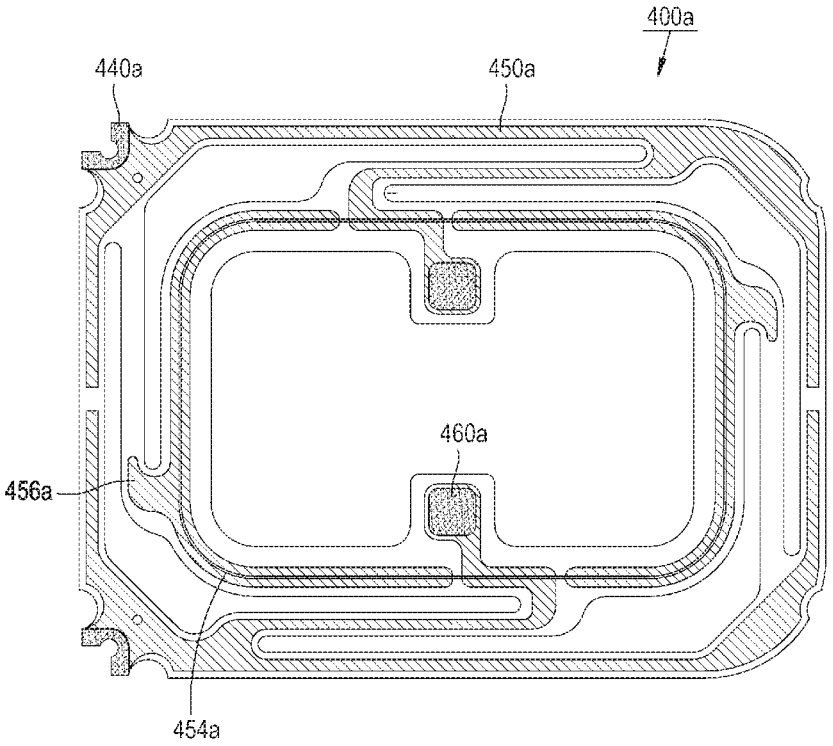

[Fig. 22]
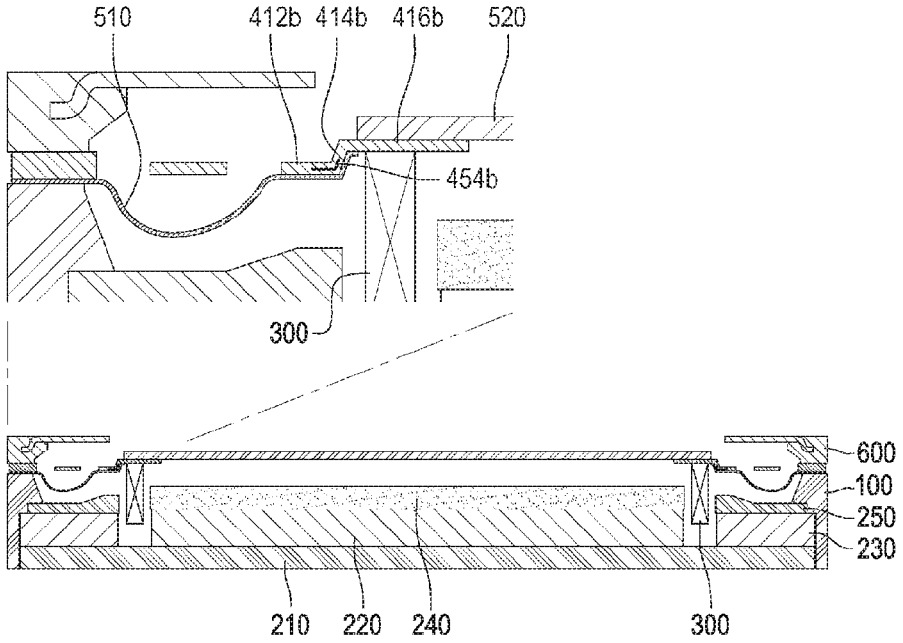
[Fig. 23]
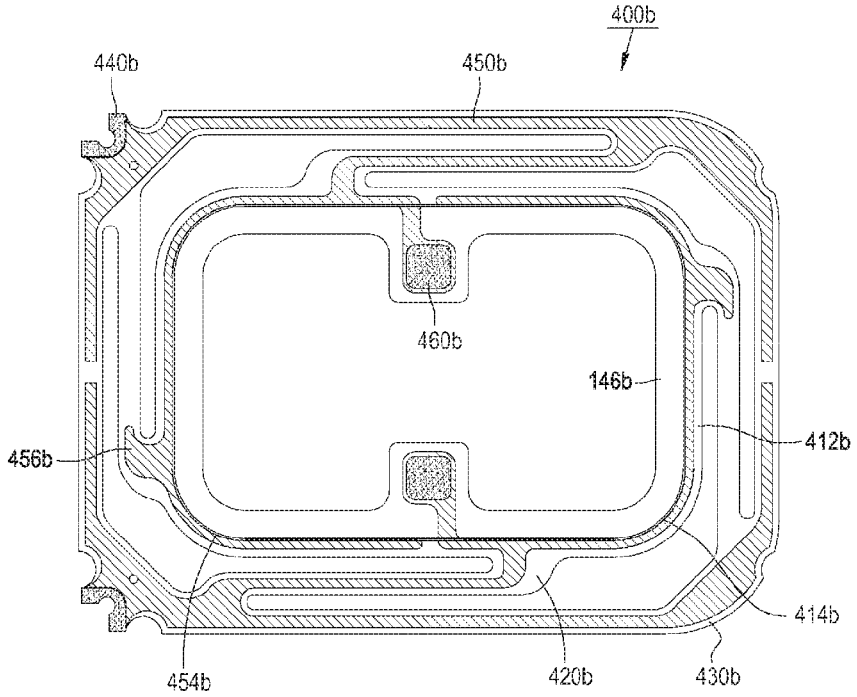

[Fig. 24]
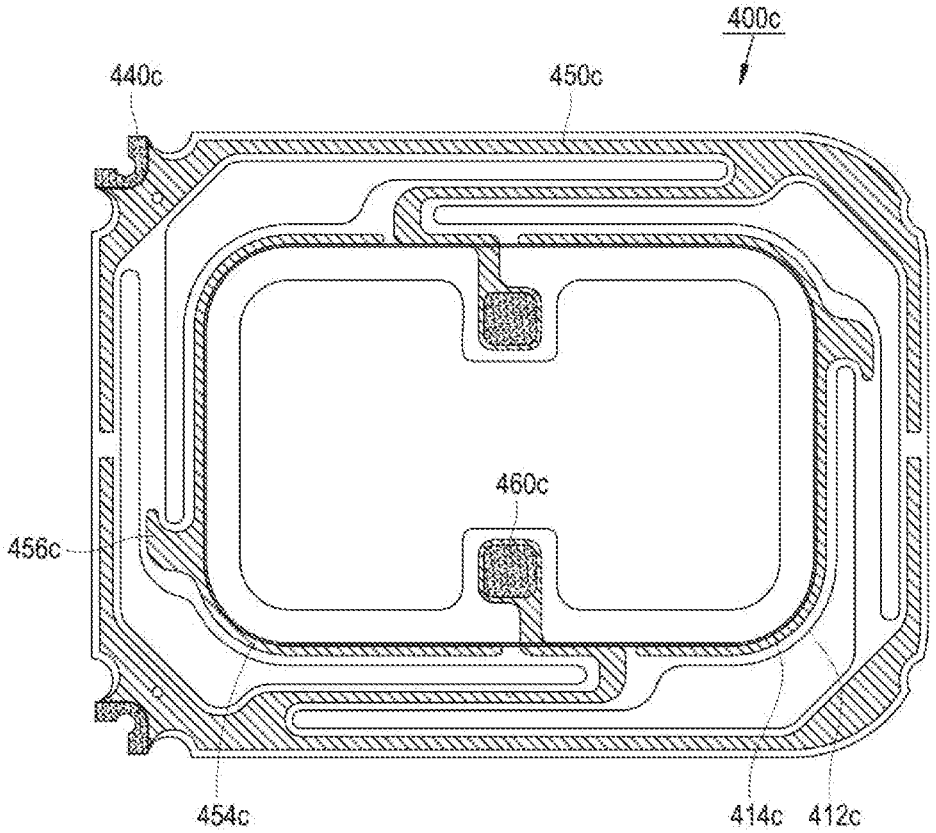
[Fig. 25]
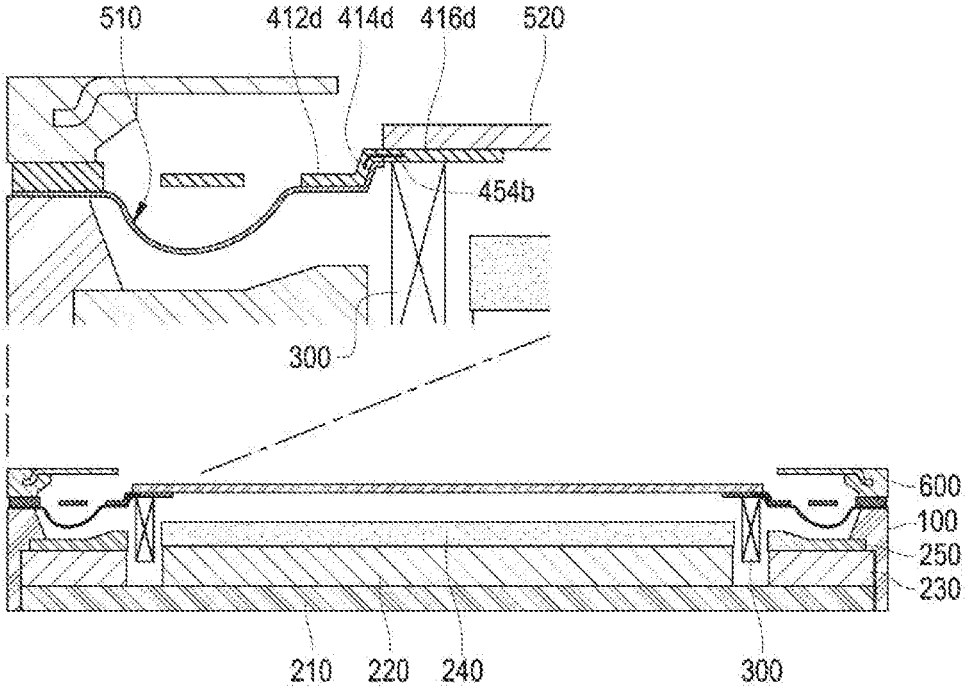

[Fig. 26]
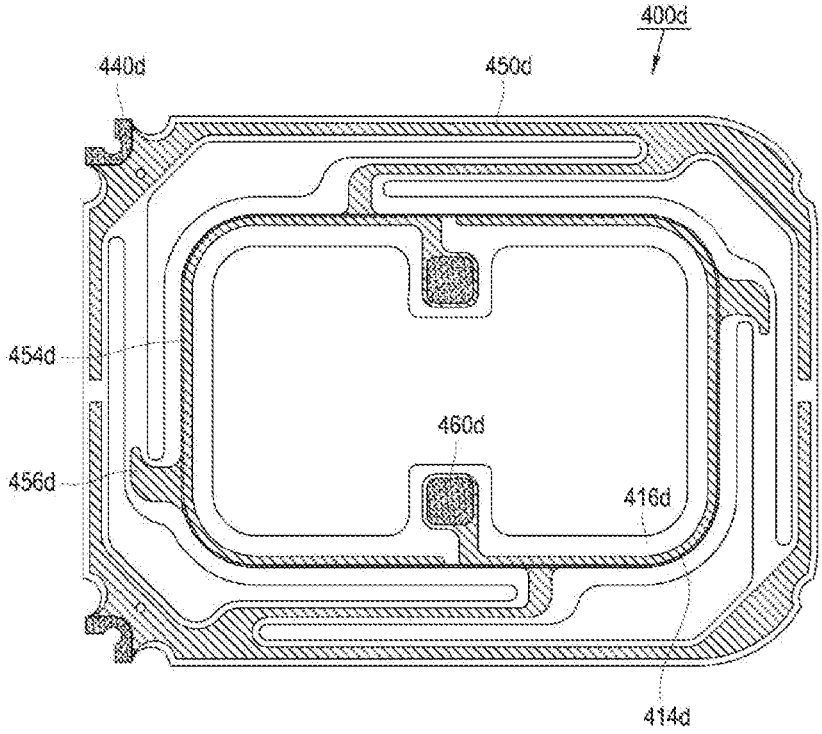
[Fig. 27]
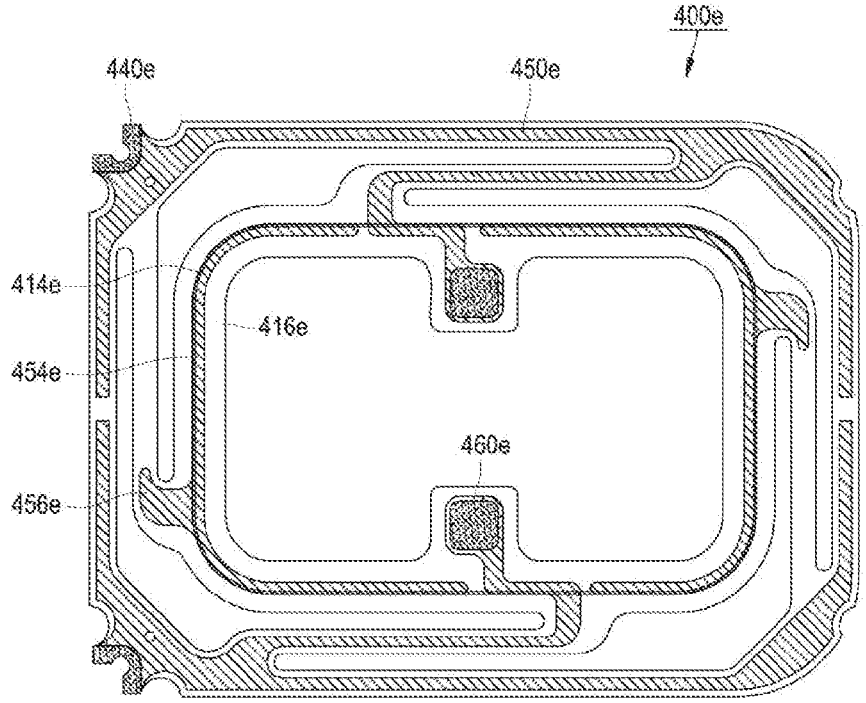

SLIM MICROSPEAKER

PRIORITY CLAIMS

The present application claims priority to Korean Patent Application No. 10-2014-0180278 filed on 15 Dec. 2014, to Korean Patent Application No. 10-2015-0033854 filed on 11 Mar. 2015, and to Korean Patent Application No. 10-2015-0033855 filed on 11 Mar. 2015, the content of said applications incorporated herein by reference in their entirety.

TECHNICAL FIELD

The present invention relates to, and more particularly, to a slim microspeaker which is thin in thickness and, more particularly, to a slim microspeaker having a suspension structure modified to make the microspeaker slimmer, prevent biased vibration, and increase a full height of a voice coil.

BACKGROUND

FIG. 1 is an exploded perspective view of a related art microspeaker, and FIG. 2 is a cross-sectional perspective view of the related art microspeaker. The related art microspeaker includes a yoke 21, an inner ring magnet 22, an outer ring magnet 23, an inner ring top plate 24, and an outer ring top plate 25 installed within a frame 10, and a voice coil 30 is positioned in an air gap between the inner ring magnet 22 and the outer ring magnet 23. When power is applied to the voice coil 30, the voice coil 30 vibrates up and down. The voice coil 30 is installed on a lower surface of a suspension 40, and a side vibration plate 51 and a central vibration plate 52 are respectively installed on upper and lower surfaces of the suspension 40 and vibrate together to generate a sound according to vibration of the voice coil 30. A protector 60 is coupled to an upper side of the suspension 40 to protect components positioned within the speaker. The protector 60 includes an annular still part 61 having an opening 63 formed in a central portion thereof to emit a sound and an annular injection part 62 allowing the still part 61 to be inserted therein so as to be injection-molded and stacked on an outer circumferential portion of the side vibration plate 51 and on an outer circumferential portion of the suspension 50.

In order to apply power from the outside to the voice coil 30, the related art microspeaker includes a terminal pad 70 attached to a lower portion of the frame 10 to provide a connection point with an external terminal. The terminal pad 70 is inserted when the frame 10 is injection-molded, so that the terminal pad 70 is coupled to the frame 10 through insert injection molding.

Here, the suspension 40, to which the voice coil 30, the side vibration plate 51, and the central vibration plate 52 are attached, guiding vibration is formed of a flexible printed circuit board (FPCB) and serves to apply power from the terminal pad 70 to the voice coil 30.

Recently, mobile devices equipped with a microspeaker have reduced in thickness, and in line with this, microspeakers tend to become slimmer. However, as microspeakers are reduced in thickness, sizes of major components of the microspeakers such as a voice coil, or the like, have also been reduced in thickness, resulting in a degradation of sound characteristics. Thus, it is required to develop a microspeaker able to exhibit excellent sound characteristics, while achieving slimness.

SUMMARY

An object of the present invention is to provide a microspeaker including a voice coil exhibiting excellent sound characteristics and a suspension having a voice coil installation structure for reducing a thickness of the microspeaker.

Another object of the present invention is to provide a microspeaker including a suspension having a voice coil installation structure for reducing a thickness of the microspeaker and a structure for restraining biased vibration.

According to an aspect of the present invention for achieving the above objects, there is provided a slim microspeaker including: a frame; a magnetic circuit; a voice coil generating vibration by mutual electromagnetic force with the magnetic circuit; a vibration plate vibrating together according to vibration of the voice coil to generate a sound; and a suspension guiding a vibration direction of the vibration plate and the voice coil and having a central portion to which the voice coil is attached, an annular outer circumferential portion formed to be spaced apart from the central portion by a predetermined interval, and a connection portion connecting the central portion and the outer circumferential portion and performing a damping function, wherein the central portion has an outer end having the same height as those of the connection portion and the outer circumferential portion, an inner end positioned to be higher than the outer end, and a step portion connecting the outer end and the inner end, and the voice coil is attached to the inner end.

In another example of the present invention, the central portion of the suspension may have a hollow portion, and the vibration plate may include a central vibration plate attached to an upper surface of a high portion of the central portion of the suspension and a side vibration plate having an inner circumferential portion attached to a lower surface of the central portion, an outer circumferential portion mounted on the frame, and a dome portion positioned between the inner circumferential portion and the outer circumferential portion and protruding downwardly.

Also, in another example of the present invention, the inner circumferential portion of the side vibration plate may be attached to the outer end and the step portion of the central portion of the suspension.

Also, in another example of the present invention, the inner circumferential portion of the side vibration plate may be attached to the outer end, the step portion, and the inner end of the central portion of the suspension, and the voice coil may be attached to a lower surface of the side vibration plate.

Also, in another example of the present invention, the central vibration plate may be formed of a metal foam material.

Also, in another example of the present invention, the central vibration plate may be formed of a polymer film, and include a plurality of dome portions.

Also, in another example of the present invention, the inner end of the central portion of the suspension may be provided as a surface without a hollow so as to serve as a central vibration plate, and the vibration plate may include a side vibration plate having an inner circumferential portion attached to a lower surface of the central portion, an outer circumferential portion mounted on the frame, and a dome portion positioned between the inner circumferential portion and the outer circumferential portion and protruding downwardly.

Also, in another example of the present invention, the vibration plate may include a side vibration plate having an inner circumferential portion attached to an upper surface of the central portion, an outer circumferential portion mounted on the frame, and a dome portion positioned between the inner circumferential portion and the outer circumferential portion and protruding downwardly.

Also, in another example of the present invention, the inner circumferential portion may have a shape corresponding to the inner end, the outer end, and the step portion of the suspension, and may be attached to an upper surface of the suspension.

Also, in another example of the present invention, the inner circumferential portion may be provided as a surface without a hollow.

Also, in another example of the present invention, the inner end of the suspension may be provided as a surface without a hollow.

Also, in another example of the present invention, the vibration plate may further include a central vibration plate attached to an upper surface of the inner circumferential portion of the side vibration plate.

Also, in another example of the present invention, the central vibration plate may be formed of a metal-foam material.

Also, in another example of the present invention, the central vibration plate may be formed of a polymer film and have one or more dome portions.

Also, in another example of the present invention, the central portion may have a vibration plate attachment portion provided at an inner side of the inner end thereof to which the vibration plate is attached, and a position of the vibration plate attachment portion may be lower than that of the inner end.

Also, in another example of the present invention, the central vibration plate may be attached to an upper surface of the vibration plate attachment portion.

Also, in another example of the present invention, a width of the inner end may range from 0.35 mm to 2.0 mm.

Also, in another example of the present invention, a width of the vibration plate attachment portion may range from 0.2 mm to 2.0 mm.

Also, in another example of the present invention, the central portion may have a vibration plate attachment portion extending to an inner side and having the same height as that of the inner end, and the vibration plate may be attached to a lower surface of the vibration plate attachment portion.

Also, in another example of the present invention, a width of the inner end may be 0.35 mm or greater.

Also, in another example of the present invention, a width of the vibration plate attachment portion may range from 0.2 mm to 2.0 mm.

Also, in another example of the present invention, the suspension may have a conductive pattern transmitting an electric signal to the voice coil attached from the outer circumferential portion thereof to the central portion thereof, and the step portion thereof may have a metal dummy pattern for preventing distortion of the suspension and biased vibration.

Also, in another example of the present invention, a width of the metal dummy pattern may extend up to a portion of the outer end and up to a portion of the inner end.

Also, in another example of the present invention, a width of the metal dummy pattern may extend from the step portion up to a portion of the outer end.

Also, in another example of the present invention, a width of the metal dummy pattern may extend from the step portion up to a portion of the inner end.

Also, in another example of the present invention, the metal dummy pattern may be connected to the conductive pattern.

Also, in another example of the present invention, the metal dummy pattern may be provided to be separated from the conductive pattern.

Also, in another example of the present invention, the metal dummy pattern may extend up to a portion of the connection portion.

According to the slim microspeaker provided in the present disclosure, a space margin is optimized by providing a step in the central portion of the suspension to which the voice coil is attached, whereby the microspeaker may be reduced in thickness without reducing a full height of the voice coil.

Also, according to the slim microspeaker provided in the present disclosure, a wire diameter and the number of turns of the voice coil may be designed to be increased at the maximum for the microspeaker having the same size, and a customized design may be provided by adjusting a step of the suspension according to the full height of the voice coil.

In addition, according to the slim microspeaker provided in the present disclosure, sound pressure level (SPL) of lower frequencies may be maximized and F0 may be optimized.

Moreover, according to the slim microspeaker provided in the present disclosure, since the voice coil attachment position is moved to a higher position due to the step provided in the central portion of the suspension, a full height of the voice coil may be increased, and also, since the dummy pattern is formed in the step portion, distortion of the suspension may be prevented and biased vibration and divided vibration of the vibration unit may be prevented.

BRIEF DESCRIPTION OF THE DRAWINGS

FIG. 1 is an exploded perspective view of the related art microspeaker;

FIG. 2 is a cross-sectional view of the related art microspeaker;

FIG. 3 is an exploded perspective view of a slim microspeaker according to a first embodiment of the present invention;

FIG. 4 is a cross-sectional view illustrating a slim microspeaker according to the first embodiment of the present invention;

FIG. 5 is a view illustrating a suspension and a side vibration plate provided in the slim microspeaker according to the first embodiment of the present invention;

FIG. 6 is a view illustrating a suspension provided in a slim microspeaker according to a second embodiment of the present invention;

FIG. 7 is a cross-sectional view of the slim microspeaker according to the second embodiment of the present invention;

FIG. 8 is a view illustrating a suspension and a central vibration plate provided in a slim microspeaker according to a third embodiment of the present invention;

FIG. 9 is a cross-sectional view of the slim microspeaker according to the third embodiment of the present invention;

FIG. 10 is a view illustrating a suspension and a side vibration plate provided in a slim microspeaker according to a fourth embodiment of the present invention;

FIG. 11 is a cross-sectional view of the slim microspeaker according to the fourth embodiment of the present invention;

FIG. 12 is a cross-sectional view of a slim microspeaker according to a fifth embodiment of the present invention;

FIG. 13 is a cross-sectional view of a slim microspeaker according to a sixth embodiment of the present invention;

FIG. 14 is a cross-sectional view of a slim microspeaker according to a seventh embodiment of the present invention;

FIG. 15 is a cross-sectional view of a slim microspeaker according to an eighth embodiment of the present invention;

FIG. 16 is a cross-sectional view of a slim microspeaker according to a ninth embodiment of the present invention;

FIG. 17 is a cross-sectional view of a slim microspeaker according to a tenth embodiment of the present invention;

FIG. 18 is a cross-sectional view of a slim microspeaker according to an eleventh embodiment of the present invention;

FIG. 19 is a cross-sectional view of a slim microspeaker in which biased vibration is improved according to a twelfth embodiment of the present invention;

FIG. 20 is a view illustrating a suspension provided in the slim microspeaker in which biased vibration is improved according to the twelfth embodiment of the present invention;

FIG. 21 is a view illustrating a suspension provided in the slim microspeaker in which biased vibration is improved according to a thirteenth embodiment of the present invention;

FIG. 22 is a cross-sectional view of a slim microspeaker in which biased vibration is improved according to a fourteenth embodiment of the present invention;

FIG. 23 is a view illustrating a suspension provided in the slim microspeaker in which biased vibration is improved according to the fourteenth embodiment of the present invention;

FIG. 24 is a view illustrating a suspension provided in the slim microspeaker in which biased vibration is improved according to a fifteenth embodiment of the present invention;

FIG. 25 is a cross-sectional view of a slim microspeaker in which biased vibration is improved according to a sixteenth embodiment of the present invention;

FIG. 26 is a view illustrating a suspension provided in the slim microspeaker in which biased vibration is improved according to the sixteenth embodiment of the present invention; and FIG. 27 is a view illustrating a suspension provided in the slim microspeaker in which biased vibration is improved according to a seventeenth embodiment of the present invention.

DETAILED DESCRIPTION

Hereinafter, embodiments of the present invention will be described in detail.

FIG. 3 is an exploded perspective view of a slim microspeaker according to a first embodiment of the present invention, FIG. 4 is a cross-sectional view illustrating a slim microspeaker according to the first embodiment of the present invention, and FIG. 5 is a view illustrating a suspension and a side vibration plate provided in the slim microspeaker according to the first embodiment of the present invention.

FIG. 3 is an exploded perspective view of a slim microspeaker according to a first embodiment of the present invention. The slim microspeaker according to the first embodiment of the present invention includes a frame 100, a magnetic circuit installed within the frame 100, a vibrator generating vibration by mutual electromagnetic force with the magnetic circuit, a protector 600 coupled to an upper side of the frame 100 to protect the magnetic circuit and the vibrator, and a terminal pad 700 insert injection-molded within the frame 100.

The magnetic circuit includes a yoke 210 coupled to the frame 100, an inner ring magnet 220 attached to the yoke 210, an annular outer ring magnet 230 attached to the yoke 210 such that the annular outer ring magnet 230 is spaced apart from the inner ring magnet 220 by a predetermined interval, an inner ring top plate 240 covering the inner ring magnet 220 and assisting formation of magnetic flux, and an outer ring top plate 250 covering the outer ring magnet 230 and assisting formation of magnetic flux. A space between the inner ring magnet 220 and the outer ring magnet 230 is also termed an air gap, in which a lower end of the voice coil 300 of the vibrator (to be described hereinafter) is positioned. When a current flows in the voice coil 300, the voice coil 300 vibrates up and down by mutual electromagnetic force with the magnetic circuit.

The vibrator includes the voice coil 300, the suspension 400, and vibration plates 510 and 520. The vibration plates 510 and 520 include a side vibration plate 510 and a central vibration plate 520. As discussed above, when an electrical signal is applied to the voice coil 300, the voice coil 300 vibrates by mutual electromagnetic force with the magnetic circuit, and here, the suspension 400 guides vibration of the voice coil 300 such that the voice coil 300 vibrates only in a vertical direction. The voice coil 300 and the vibration plates 510 and 520 are attached to the suspension 400, and the vibration plates 510 and 520 vibrate together according to vibration of the voice coil 300 to generate a sound. The central vibration plate 520 may be formed of a polymer film or metal foam.

The protector 600 is provided at the uppermost portion and coupled to the frame 100 to protect the magnetic circuit and the vibrator.

The suspension 400 according to an embodiment of the present invention includes a central portion 410 to which the voice coil 300 is attached, an annular outer circumferential portion 430 formed to be spaced apart from the central portion 410 by a predetermined interval, and a connection portion 420 connecting the central portion 410 and the outer circumferential portion 430 and performing a damping function. The central portion 410 has a step. The central portion 410 has an outer end 416 having the same height as those of the connection portion 420 and the outer circumferential portion 430, an inner end 412 positioned to be higher than the outer end 416, and a step portion 414 connecting the outer end 416 and the inner end 412. The voice coil 300 is attached to the inner end 412 positioned to be higher than the outer circumferential portion 430 mounted on the frame 100, elevating a position to which an upper end of the voice coil 300 is attached, to thus increase a space for installation of the voice coil 300. Thus, a wire diameter and the number of turns of the voice coil 300 may be increased, a sound pressure level (SPL) of lower frequencies may be increased, and F0 may be reduced. Also, since a full height of the voice coil 300 is increased, mutual electromagnetic force may be strengthened to increase the SPL of full band as well as that of lower frequencies.

The suspension 400 is manufactured as a flexible printed circuit board (FPCB) to provide an electrical connection between the terminal pad 700 and the voice coil 300. Here, a landing portion 440 for an electrical connection with the terminal pad 700 may be provided at the outer circumferential portion 430, and a landing portion 418 for an electrical connection with the voice coil 300 may be provided at an inner side of the central portion 410.

The side vibration plate 510 provided in the first embodiment of the present invention has an inner circumferential portion 512 attached to a lower surface of the central portion 410 of the suspension 400, an outer circumferential portion 514 mounted on the frame, and a dome portion 516 positioned between the inner circumferential portion 516 and the outer circumferential portion 514 and protruding downwardly. That is, the side vibration plate 510 provided in the first embodiment is reverse dome-type vibration plate in which the dome portion 516 protrudes in a downward direction. Here, the inner circumferential portion 512 of the side vibration plate 510 includes an extending portion 511 attached to the step portion 414, and here, the inner circumferential portion 512 is attached to the outer end 416 of the suspension 400 and the extending portion 511 is attached to the step portion 414 of the suspension 400.

FIG. 6 is a view illustrating a suspension provided in a slim microspeaker according to a second embodiment of the present invention, and FIG. 7 is a cross-sectional view of the slim microspeaker according to the second embodiment of the present invention.

In the slim microspeaker according to the second embodiment of the present invention, a suspension 400*a* serves as a central vibration plate, and thus, shapes of components and coupling relationships between the components of the slim microspeaker according to the second embodiment of the present invention are the same as those of the slim microspeaker according to the first embodiment, except that a central vibration plate is omitted and a shape of the central portion 410*a* is changed.

Similar to the first embodiment, the suspension 400*a* of the slim microspeaker according to the second embodiment of the present invention includes the central portion 410*a*, a connection portion 420*a*, and an outer circumferential portion 430*a*, and has a landing portion 440*a* for an electrical connection of the voice coil 300 with the terminal pad 700 (please refer to FIG. 3). Unlike the first embodiment, an inner end 412*a* is provided as a surface without a hollow. Thus, the inner end 412*a* vibrates by air to generate a sound. The side vibration plate 510 is attached to a lower surface of the suspension 400*a*, and the inner circumferential portions 511 and 512 of the side vibration plate 510 are attached to the outer end 416 and the step portion 414*a*.

FIG. 8 is a view illustrating a suspension and a central vibration plate provided in a slim microspeaker according to a third embodiment of the present invention, and FIG. 9 is a cross-sectional view of the slim microspeaker according to the third embodiment of the present invention.

Shapes of components and coupling relationships between the components of the slim microspeaker according to the third embodiment of the present invention are the same as those of the slim microspeaker according to the first embodiment, except for a shape of a central vibration plate 520*b*.

The central vibration plate 520*b* provided in the slim microspeaker according to the third embodiment of the present invention is provided as a polymer film and attached to an upper surface of a central portion of the suspension 400. Since the central vibration plate 520*b* is provided as a polymer film, it has a plurality of dome portions to reinforce rigidity. The central vibration plate 520*b* includes an attachment portion 522*b* attached to an inner end of the suspension 400 and a landing portion for a voice coil, a normal dome portion 524*b* protruding upwardly from the attachment portion 522*b*, and a reverse dome portion 526*b* protruding downwardly from the attachment surface 522*b*. The central vibration plate 520*b* illustrated in FIG. 8 has both the normal dome portion 524*b* and the reverse dome portion 526*b* as dome portions, but the central vibration portion 520*b* may have only the normal dome portion 524*b* or the reverse dome portion 526*b*.

FIG. 10 is a view illustrating a suspension and a side vibration plate provided in a slim microspeaker according to a fourth embodiment of the present invention, and FIG. 11 is a cross-sectional view of the slim microspeaker according to the fourth embodiment of the present invention.

Shapes of components and coupling relationships between the components of the slim microspeaker according to the fourth embodiment of the present invention are the same as those of the slim microspeaker according to the first embodiment, except for a shape of a side vibration plate 510*c* and an attachment position of the voice coil 300.

Similar to the first embodiment, the side vibration plate 510*c* provided in the slim microspeaker according to the fourth embodiment of the present invention includes an inner circumferential portion 512*c*, an outer circumferential portion 514*c*, and a dome portion 516*c*, and unlike the first embodiment, the side vibration plate 510*c* further includes a steep portion 511*c* and an inner end 513*c*. The step portion 511*c* of the side vibration plate 510*c* is attached to the step portion 414 of the suspension 400, and the inner end 513*c* of the side vibration plate 510*c* is attached to the inner end 412 of the suspension 400. The voice coil 300 is attached to a lower surface of the inner end 513*c* of the side vibration plate 510*c*.

FIG. 12 is a cross-sectional view of a slim microspeaker according to a fifth embodiment of the present invention. Shapes of components and coupling relationships between the components of the slim microspeaker according to the fifth embodiment of the present invention are the same as those of the slim microspeaker according to the first embodiment, except for a shape of a side vibration plate 510*d*. In the side vibration plate 510*d* provided in the slim microspeaker according to the fifth embodiment of the present invention, a dome portion thereof is a normal dome portion protruding upwardly, and thus, in order to avoid interference between the dome portion and the suspension 400, the side vibration plate 510*d* is attached to an upper surface of the suspension 400. The side vibration plate 510*d* has a shape corresponding to an upper end and a step portion of the suspension 400, and the central vibration plate 520 and the side vibration plate 510*d* do not overlap each other when attached.

FIG. 13 is a cross-sectional view of a slim microspeaker according to a sixth embodiment of the present invention. Shapes of components and coupling relationships between the components of the slim microspeaker according to the fifth embodiment of the present invention are the same as those of the slim microspeaker according to the first embodiment, except for a shape of a side vibration plate 510*e*.

Like the second embodiment, in the slim microspeaker according to the sixth embodiment of the present invention, a suspension 400*a* serves as a central vibration plate, and thus, a central vibration plate is omitted and the inner end of a central portion of the suspension 400*a* is provided as a surface which is not hollowed.

The side vibration plate 510*e* provided in the slim microspeaker according to the sixth embodiment of the present invention includes an inner circumferential portion 512*e* attached to an upper surface of the suspension 400*a* and attached to an outer end of the suspension 400*a*, an outer circumferential portion 514*e* attached to an outer circumferential portion of the suspension 400*a*, and a dome portion 516*e* positioned between the inner circumferential portion 512*e* and the outer circumferential portion 514*e* and protruding upwardly. Also, the side vibration plate 510*e* includes a step portion 511*e* attached to the end portion of the suspension 400*a* and an inner end 513*e* attached to the inner end of the suspension 400*a*. The inner end of the side vibration plate 513*e* is also provided as a surface without a hollow, like the suspension 400*a*. Thus, the entire upper surface of the suspension 400*a* is covered by the side vibration plate 513*e*, and thus, even in a case in which water is introduced from above, the water stays on an upper portion of the side vibration plate 513*e* and cannot penetrate through a component in which a current flows, such as the voice coil 300 or the FPCB formed in the suspension 400*a*. That is, the slim microspeaker according to the sixth embodiment of the present invention is waterproof.

FIG. 14 is a cross-sectional view of a slim microspeaker according to a seventh embodiment of the present invention. The slim microspeaker according to the seventh embodiment of the present invention includes the side vibration plate 510*e* of the slim microspeaker according to the sixth embodiment of the present invention and the central vibration plate 520*b* of the slim microspeaker according to the third embodiment of the present invention. Other components of the slim microspeaker according to the seventh embodiment of the present invention are the same as those of the slim microspeaker according to the first embodiment of the present invention.

In the slim microspeaker according to the seventh embodiment of the present invention, a central portion of the suspension 400 is hollowed but the side vibration plate 510*e* is not hollowed and watertight to protect components therebelow against water. The central vibration plate 520*b* is formed of a polymer film and attached to an upper portion of the side vibration plate 510*e*. Since the side vibration plate 510*e* is not hollowed, the central vibration plate 520*b* has only a normal dome portion protruding upwardly. One or more normal dome portions, that is, one or a plurality of normal dome portions, may be provided.

FIG. 15 is a cross-sectional view of a slim microspeaker according to an eighth embodiment of the present invention. The slim microspeaker according to the eighth embodiment of the present invention includes the side vibration plate 510*e* of the slim microspeaker according to the sixth embodiment of the present invention, and other components of the slim microspeaker according to the eighth embodiment of the present invention are the same as those of the slim microspeaker according to the first embodiment of the present invention.

In the slim microspeaker according to the eighth embodiment of the present invention, a central portion of the suspension 400 is hollowed but the side vibration plate 510*e* is not hollowed and watertight to protect components therebelow against water. The central vibration plate 520*b* is formed of a metal-foam and attached to an upper portion of the side vibration plate 510*e*.

FIG. 16 is a cross-sectional view of a slim microspeaker according to a ninth embodiment of the present invention. The slim microspeaker according to the ninth embodiment of the present invention includes a frame 100, a magnetic circuit installed within the frame 100, a vibrator generating vibrations by mutual electromagnetic force with the magnetic circuit, and a protector 600 coupled to an upper side of the frame 100 to protect the magnetic circuit and the vibrator.

The magnetic circuit includes a yoke 210 coupled to the frame 100, an inner ring magnet 220 attached to the yoke 210, an annular outer ring magnet 230 attached to the yoke 210 such that the annular outer ring magnet 230 is spaced apart from the inner ring magnet 220 by a predetermined interval, an inner ring top plate 240 covering the inner ring magnet 220 and assisting formation of magnetic flux, and an outer ring top plate 250 covering the outer ring magnet 230 and assisting formation of magnetic flux. A space between the inner ring magnet 220 and the outer ring magnet 230 is also termed an air gap, in which a lower end of the voice coil 300 of the vibrator (to be described hereinafter) is positioned. When a current flows in the voice coil 300, the voice coil 300 vibrates up and down by mutual electromagnetic force with the magnetic circuit.

The vibrator includes the voice coil 300, the suspension 400, and vibration plates 510 and 520. The vibration plates 510 and 520 include a side vibration plate 510 and a central vibration plate 520. As discussed above, when an electrical signal is applied to the voice coil 300, the voice coil 300 vibrates by mutual electromagnetic force with the magnetic circuit, and here, the suspension 400 guides vibration of the voice coil 300 such that the voice coil 300 vibrates only in a vertical direction. The voice coil 300 and the vibration plates 510 and 520 are attached to the suspension 400, and the vibration plates 510 and 520 vibrate together according to vibration of the voice coil 300 to generate a sound. The central vibration plate 520 may be formed of a polymer film, a metal, or metal foam.

The protector 600 is provided at the uppermost portion and coupled to the frame 100 to protect the magnetic circuit and the vibrator.

The suspension 400 according to the ninth embodiment of the present invention includes a central portion 430 to which the voice coil 300 and the central vibration plate 520 are attached, an annular outer circumferential portion 410 formed to be spaced apart from the central portion 430 by a predetermined interval, and a connection portion 420 connecting the central portion 430 and the outer circumferential portion 410 and performing a damping function. Here, the central portion 430 has a step. The step is formed between an inner end 434 and an outer end 432 such that an upper end of the voice coil 300 is positioned to be higher than the outer circumferential portion 410. Also, the central portion 430 has a vibration plate attachment portion 436 at an inner side of the inner end 434 to which the central vibration plate 520 is attached, and a step is also formed between the vibration plate attachment portion 436 and the inner end 434 such that a position of the vibration plate attachment portion 436 is lower than that of the inner end 434. The central vibration plate 520 is attached to a lower surface of the vibration plate attachment portion 436. Here, a width of the inner end 434 preferably ranges from 0.35 mm to 2.0 mm, and a width of the vibration plate attachment portion 436 preferably ranges from 0.2 mm to 2.0 mm.

The voice coil 300 is attached to the inner end 434 positioned to be higher than the outer circumferential portion 410 mounted on the frame 100, elevating a position to which an upper end of the voice coil 300 is attached, to thus increase a space for installation of the voice coil 300. Thus, a wire diameter and the number of turns of the voice coil 300 may be increased, a sound pressure level (SPL) of lower frequencies may be increased, and FO may be reduced. Also, since a full height of the voice coil 300 is increased, mutual electromagnetic force may be strengthened to increase the SPL of full band as well as that of lower frequencies.

The side vibration plate 510 provided in the ninth embodiment of the present invention includes an inner circumferential portion 511 attached to a lower surface of the central portion 430 of the suspension 400, an outer circumferential portion 512 mounted on the frame, and a dome portion 513 positioned between the inner circumferential portion 511 and the outer circumferential portion 512 and protruding downwardly. That is, the side vibration plate 510 provided in the ninth embodiment of the present invention is a reverse dome-type vibration plate in which the dome portion 513 protrudes in a downward direction. Here, the inner circumferential portion of the side vibration plate 510 includes an extending portion 514 attached to the step portion 433 between the outer end 432 and the inner end 434, and here, the inner circumferential portion is attached to the outer end 432 of the suspension 400 and the extending portion 514 is attached to the step portion 433 of the suspension 400.

FIG. 17 is a cross-sectional view of a slim microspeaker according to a tenth embodiment of the present invention. The slim microspeaker according to the tenth embodiment of the present invention includes the same components as those of the slim microspeaker according to the ninth embodiment of the present invention, except that a central vibration plate 520' includes a plurality of dome portions 522'. The central vibration plate 520' provided in the slim microspeaker according to the tenth embodiment of the present invention is formed of a polymer film and includes the plurality of dome portions 522' to reinforce rigidity. The central vibration plate 520' may include a normal dome portion (not shown) protruding upwardly from an attachment surface attached to an inner end of the suspension 400 and a reverse dome portion (not shown) protruding downwardly from the attachment surface. The central vibration plate 520' illustrated in FIG. 17 has only the normal dome portion as the dome portion 522', but the central vibration portion 520' may have only the reverse dome portion or both the normal dome portion and the reverse dome portion.

FIG. 18 is a cross-sectional view of a slim microspeaker according to an eleventh embodiment of the present invention. The slim microspeaker according to the eleventh embodiment of the present invention includes the same components as those of the slim microspeaker according to the ninth embodiment of the present invention, except for a shape of a suspension 400' and an attachment position of the central vibration plate 520. The suspension 400' according to the eleventh embodiment of the present invention includes a central portion 430' to which the voice coil 300 and the central vibration plate 520 are attached, an annular outer circumferential portion 410' formed to be spaced apart from the central portion 430' by a predetermined interval, and a connection portion 420' connecting the central portion 430' and the outer circumferential portion 410' and performing a damping function. Here, the central portion 430' has a step, like the ninth embodiment. A step 433' is formed between an inner end 434' and an outer end 432' such that an upper end of the voice coil 300 is positioned to be higher than the outer circumferential portion 410'. Also, the central portion 430' has a vibration plate attachment portion 436' at an inner side of the inner end 434' to which the central vibration plate 520 is attached. A position of the vibration plate attachment portion 436' is at the same height as that of the inner end 434' and a step is not formed between the vibration plate attachment portion 436' and the inner end 434'. Here, a width of the inner end 434' preferably ranges from 0.35 or greater, and a width of the vibration plate attachment portion 436' preferably ranges from 0.2 mm to 2.0 mm.

FIG. 19 is a cross-sectional view of a slim microspeaker in which biased vibration is improved according to a twelfth embodiment of the present invention, and FIG. 20 is a view illustrating a suspension provided in the slim microspeaker in which biased vibration is improved according to the twelfth embodiment of the present invention.

The slim microspeaker according to the twelfth embodiment of the present invention includes a frame 100, a magnetic circuit installed within the frame 100, a vibrator generating vibrations by mutual electromagnetic force with the magnetic circuit, a protector 600 coupled to an upper side of the frame 100 to protect the magnetic circuit and the vibrator, and a terminal pad 700 insert injection-molded within the frame 100.

The magnetic circuit includes a yoke 210 coupled to the frame 100, an inner ring magnet 220 attached to the yoke 210, an annular outer ring magnet 230 attached to the yoke 210 such that the annular outer ring magnet 230 is spaced apart from the inner ring magnet 220 by a predetermined interval, an inner ring top plate 240 covering the inner ring magnet 220 and assisting formation of magnetic flux, and an outer ring top plate 250 covering the outer ring magnet 230 and assisting formation of magnetic flux. A space between the inner ring magnet 220 and the outer ring magnet 230 is also termed an air gap, in which a lower end of the voice coil 300 of the vibrator (to be described hereinafter) is positioned. When a current flows in the voice coil 300, the voice coil 300 vibrates up and down by mutual electromagnetic force with the magnetic circuit.

The vibrator includes the voice coil 300, the suspension 400, and vibration plates 510 and 520. The vibration plates 510 and 520 include a side vibration plate 510 and a central vibration plate 520. As discussed above, when an electrical signal is applied to the voice coil 300, the voice coil 300 vibrates by mutual electromagnetic force with the magnetic circuit, and here, the suspension 400 guides vibration of the voice coil 300 such that the voice coil 3000 vibrates only in a vertical direction. The voice coil 300 and the vibration plates 510 and 520 are attached to the suspension 400, and the vibration plates 510 and 520 vibrate together according to vibration of the voice coil 300 to generate a sound. The central vibration plate 520 may be formed of a polymer film or metal foam.

The protector 600 is provided at the uppermost portion and coupled to the frame 100 to protect the magnetic circuit and the vibrator.

The suspension 400 according to an embodiment of the present invention includes a central portion 410 to which the voice coil 300 is attached, an annular outer circumferential portion 430 formed to be spaced apart from the central portion 410 by a predetermined interval, and a connection portion 420 connecting the central portion 410 and the outer circumferential portion 430 and performing a damping function. The central portion 410 has a step. The central portion 410 has an outer end 412 having the same height as those of the connection portion 420 and the outer circumferential portion 430, an inner end 416 positioned to be higher than the outer end 412, and a step portion 414 connecting the outer end 412 and the inner end 416. The voice coil 300 is attached to the inner end 416 positioned to be higher than the outer circumferential portion 430 mounted on the frame 100, elevating a position to which an upper end of the voice coil 300 is attached, to thus increase a space for installation of the voice coil 300. Thus, a wire diameter and the number of turns of the voice coil 300 may be increased, a sound pressure level (SPL) of lower frequencies may be increased, and F0 may be reduced. Also, since a full height of the voice coil 300 is increased, mutual electromagnetic force may be strengthened to increase the SPL of full band as well as that of lower frequencies.

The suspension 400 is manufactured as a flexible printed circuit board (FPCB) to provide an electrical connection between the terminal pad 700 and the voice coil 300. Here, a first landing portion 440 for an electrical connection with the terminal pad 700 may be provided at the outer circumferential portion 430, and a second landing portion 460 for an electrical connection with the voice coil 300 may be provided at an inner side of the central portion 410.

In the present disclosure, in order to prevent distortion of the suspension 400 formed of a polymer film, dummy patterns 454 and 456 for strengthening rigidity of the suspension 400 are provided outside of a path of a conductive pattern 450 transmitting an electrical signal from the first landing portion 440 to the second landing portion 460. The dummy patter 454 is formed entirely on the step portion 414 of the suspension 400, and connected to the conductive patter 450. Since the dummy patter 454 is connected to the conductive patter 450, a portion thereof for transmitting a positive (+) signal and a portion thereof for transmitting a negative (−) signal are separately provided. As illustrated in FIGS. 19 and 20, the dummy patter 454, as well as being disposed in the step portion 414, extends even to the portions of the outer end 412 and the inner end 416 in width. Also, the dummy pattern 456 is formed to extend even to a portion of the connection portion 420 of the suspension 400, enhancing the effect of preventing distortion of the suspension 400.

FIG. 21 is a view illustrating a suspension provided in the slim microspeaker in which biased vibration is improved according to a thirteenth embodiment of the present invention. A suspension 400*a* provided in the slim microspeaker according to the thirteenth embodiment of the present invention has the same components as those of the suspension provided in the microspeaker according to the twelfth embodiment of the present invention, except for a shape of a dummy pattern 456*a*.

The suspension 400*a* provided in the slim microspeaker according to the thirteenth embodiment of the present invention is the same as that of the twelfth embodiment in that the dummy pattern 454*a* extends from the step portion 414 to the outer end 412 and the inner end 416 in width, like that of the twelfth embodiment, but different from that of the twelfth embodiment in that a conductive pattern 450*a* and the dummy pattern 454*a* are separately formed. The dummy pattern 454*a* according to the thirteenth embodiment of the present invention also has a dummy pattern 456*a* extending to a portion of the connection portion 420.

FIG. 22 is a cross-sectional view of a slim microspeaker in which biased vibration is improved according to a fourteenth embodiment of the present invention, and FIG. 23 is a view illustrating a suspension provided in the slim microspeaker in which biased vibration is improved according to the fourteenth embodiment of the present invention.

A shape of a suspension 400*b* provided in the slim microspeaker according to the fourteenth embodiment of the present invention is the same as that of the twelfth embodiment of the present invention, and only shapes of a conductive pattern 450*b* and a dummy pattern 454*b* are different.

The suspension 400*b* provided in the slim microspeaker according to the fourteenth embodiment of the present invention features that a width of the dummy pattern 454*b* extends from a step portion 414*b* only to an outer end 412*b*. The conductive pattern 450*b* and the dummy pattern 454*b* are connected like that of the twelfth embodiment.

FIG. 24 is a view illustrating a suspension provided in the slim microspeaker in which biased vibration is improved according to a fifteenth embodiment of the present invention. The suspension 400*c* provided in the slim microspeaker according to the fifteenth embodiment of the present invention features that a width of a dummy pattern 454*c* extends from a step portion 414*c* only to an outer end 412*c*, like the fourteenth embodiment. However, the suspension 400*c* is different from the suspension 400*b* of fourteenth embodiment in that a conductive pattern 450*c* and the dummy pattern 454*c* are separated from each other.

FIG. 25 is a cross-sectional view of a slim microspeaker in which biased vibration is improved according to a sixteenth embodiment of the present invention, and FIG. 26 is a view illustrating a suspension provided in the slim microspeaker in which biased vibration is improved according to the sixteenth embodiment of the present invention.

A shape of a suspension 400*d* provided in the slim microspeaker according to the sixteenth embodiment of the present invention is the same as that of the twelfth embodiment of the present invention, and only shapes of a conductive pattern 450*d* and a dummy pattern 454*d* are different.

The suspension 400*d* provided in the slim microspeaker according to the sixteenth embodiment of the present invention features that a width of the dummy pattern 454*d* extends from a step portion 414*d* only to an inner end 416*d*. The conductive pattern 450*d* and the dummy pattern 454*d* are connected like that of the twelfth embodiment.

FIG. 27 is a view illustrating a suspension provided in the slim microspeaker in which biased vibration is improved according to a seventeenth embodiment of the present invention. The suspension 400*e* provided in the slim microspeaker according to the seventeenth embodiment of the present invention features that a width of the dummy pattern 454*e* extends from a step portion 414*e* only to an inner end 416*e*, as in the sixteenth embodiment. Also, the suspension 400*e* according to the seventeenth embodiment of the present invention is different from the suspension 400*d* according to the sixteenth embodiment of the present invention, in that a conductive pattern 450*e* and a dummy pattern 454*e* are separated from each other.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A slim microspeaker, comprising:

a frame;

a magnetic circuit;

a voice coil configured to generate vibration by mutual electromagnetic force with the magnetic circuit;

a vibration plate configured to vibrate together according to the vibration of the voice coil to generate a sound; and a suspension configured to guide a vibration direction of the vibration plate and the voice coil and having a central portion to which the voice coil is attached, an annular outer circumferential portion formed to be spaced apart from the central portion by a predetermined interval, and a connection portion connecting the central portion and the outer circumferential portion and configured to perform a damping function, wherein the central portion has an outer end having the same height as the connection portion and the outer circumferential portion, an inner end positioned to be higher than the outer end, and a step portion connecting the outer end and the inner end, wherein the voice coil is attached to the inner end.

2. The slim microspeaker of claim 1, wherein the central portion of the suspension has a hollow portion, and wherein the vibration plate includes a central vibration plate attached to an upper surface of a high portion of the central portion of the suspension and a side vibration plate having an inner circumferential portion attached to a lower surface of the central portion, an outer circumferential portion mounted on the frame, and a dome portion positioned between the inner circumferential portion and the outer circumferential portion and protruding downwardly.

3. The slim microspeaker of claim 2, wherein the inner circumferential portion of the side vibration plate is attached to the outer end and the step portion of the central portion of the suspension.

4. The slim microspeaker of claim 2, wherein the inner circumferential portion of the side vibration plate is attached to the outer end, the step portion, and the inner end of the central portion of the suspension, and wherein the voice coil is attached to a lower surface of the side vibration plate.

5. The slim microspeaker of claim 1, wherein the inner end of the central portion of the suspension is provided as a surface without a hollow so as to serve as a central vibration plate, and wherein the vibration plate includes a side vibration plate having an inner circumferential portion attached to a lower surface of the central portion, an outer circumferential portion mounted on the frame, and a dome portion positioned between the inner circumferential portion and the outer circumferential portion and protruding downwardly.

6. The slim microspeaker of claim 1, wherein the vibration plate includes a side vibration plate having an inner circumferential portion attached to an upper surface of the central portion, an outer circumferential portion mounted on the frame, and a dome portion positioned between the inner circumferential portion and the outer circumferential portion and protruding downwardly.

7. The slim microspeaker of claim 6, wherein the inner circumferential portion has a shape corresponding to the inner end, the outer end, and the step portion of the suspension, and is attached to an upper surface of the suspension.

8. The slim microspeaker of claim 7, wherein the inner circumferential portion is provided as a surface without a hollow.

9. The slim microspeaker of claim 8, wherein the inner end of the suspension is provided as a surface without a hollow.

10. The slim microspeaker of claim 8, wherein the vibration plate further includes a central vibration plate attached to an upper surface of the inner circumferential portion of the side vibration plate.

11. The slim microspeaker of claim 1, wherein the central portion has a vibration plate attachment portion provided at an inner side of the inner end thereof to which the vibration plate is attached, and wherein a position of the vibration plate attachment portion is lower than that of the inner end.

12. The slim microspeaker of claim 11, wherein the central vibration plate is attached to an upper surface of the vibration plate attachment portion.

13. The slim microspeaker of in claim 1, wherein the central portion has a vibration plate attachment portion extending to an inner side and having the same height as the inner end, and wherein the vibration plate is attached to a lower surface of the vibration plate attachment portion.

14. The slim microspeaker of claim 13, wherein a width of the inner end is 0.35 mm or greater.

15. The slim microspeaker of claim 13, wherein a width of the vibration plate attachment portion ranges from 0.2 mm to 2.0 mm.

16. The slim microspeaker of claim 1, wherein the suspension has a conductive pattern configured to transmit an electric signal to the voice coil attached from the outer circumferential portion thereof to the central portion thereof, and wherein the step portion thereof has a metal dummy pattern configured to prevent distortion of the suspension and biased vibration.

17. The slim microspeaker of claim 16, wherein a width of the metal dummy pattern extends up to a portion of the outer end and up to a portion of the inner end.

18. The slim microspeaker of claim 16, wherein a width of the metal dummy pattern extends from the step portion up to a portion of the outer end.

19. The slim microspeaker of claim 16, wherein a width of the metal dummy pattern extends from the step portion up to a portion of the inner end.

20. The slim microspeaker of claim 16, wherein the metal dummy pattern is connected to the conductive pattern.

21. The slim microspeaker of claim 16, wherein the metal dummy pattern is provided to be separated from the conductive pattern.

22. The slim microspeaker of claim 16, wherein the metal dummy pattern extends up to a portion of the connection portion.

* * * * *